United States Patent [19]

Brownlee

[11] 4,346,895

[45] Aug. 31, 1982

[54] PLAYING CARD CADDY

[76] Inventor: Wanda J. Brownlee, 1131 Elmwood, Lewisville, Tex. 75067

[21] Appl. No.: 235,107

[22] Filed: Feb. 17, 1981

[51] Int. Cl.[3] ..... A63F 1/10

[52] U.S. Cl. ..... 273/150; 248/1; 248/DIG. 10

[58] Field of Search ..... 273/150, 148 A; 248/1, 248/DIG. 10

[56] References Cited

U.S. PATENT DOCUMENTS

| | | | |
|---|---|---|---|
| 2,400,296 | 5/1946 | Jacobs | 273/150 X |
| 2,956,287 | 10/1960 | Stanford | 248/1 X |
| 4,192,329 | 3/1980 | Swearingen | 248/1 X |

FOREIGN PATENT DOCUMENTS

| | | | |
|---|---|---|---|
| 408337 | 4/1934 | United Kingdom | 273/150 |

*Primary Examiner*—Anton O. Oechsle

*Attorney, Agent, or Firm*—Dennis T. Griggs

[57] ABSTRACT

A holder for displaying a hand of cards features a flexible support bag in which a volume of flowable, aggregate materials such as pebbles or sand is contained for stabilizing an up-right card display panel which is attached to the top of the support bag. The card display panel includes an array of card pockets arranged in rows and columns whereby cards can be displayed by suit and by rank within a suit. The holder assembly further includes a display panel for receiving written instructions such as bidding rules or scoring rules. Because the support bag is flexible, the display angle of the card display panel and of the written instruction display panel can be adjusted for effective use by a handicapped player who is otherwise unable to hold the cards whereby such a player can participate in a card game without assistance.

1 Claim, 2 Drawing Figures

PLAYING CARD CADDY

BACKGROUND OF THE INVENTION

1. Field of the Invention

The present invention relates generally to self-supporting playing card holders, and in particular, the invention relates to a card holder which can be used effectively by a handicapped player whereby such a player can participate in a card game without assistance.

2. Description of the Prior Art

Handicapped individuals sometimes encounter difficulties in card games, because of a particular manual handicap, wherein they are unable to arrange and manage a hand of cards without assistance. Moreover, the arrangement of cards by suit and by rank within a suit is important in many games, for example Bridge. In games such as Bridge which have complex bidding and scoring rules, it is helpful for a beginning player to be able to quickly refer to printed instructions. It will be appreciated that a person having a manual handicap will encounter great difficulty on holding and managing a hand of cards, and that for full enjoyment of the game, it is desirable to participate without assistance.

OBJECTS OF THE INVENTION

The principal object of the present invention is, therefore, to provide a holder for playing cards which can be used effectively by a handicapped person who is unable to hold the cards whereby such a player can participate in a card game without assistance.

A general object of the present invention is to provide a holder for playing cards.

A particular object of the invention is to provide a holder which simultaneously displays a hand of playing cards together with written instructions such as bidding rules or scoring rules.

Another object of the invention is to provide a holder for playing cards which has a stable but movable base for adjusting the display angle.

Yet another object of the invention is to provide a holder for separately displaying cards by suit, and by rank within a suit.

Still another object of this invention is to provide a holder for displaying cards in which individual cards may be withdrawn without disturbing the remaining cards.

A further object of this invention is to provide a card holder for separately displaying cards in which the cards remain securely in place, even when the holder is tipped over.

Another object of this invention is to provide a holder for playing cards which clearly displays the cards to the player, but provides privacy with respect to other players.

SUMMARY OF THE INVENTION

The foregoing objects are achieved by a card holder assembly which includes a flexible support bag in which a volume of flowable, aggregate material such as pebbles or sand is contained. An up-right card display panel is secured to the top of the support bag, and includes an array of card pockets arranged in rows and columns wherein the cards can be separately displayed by suit, and by rank within a suit. Because the support bag is flexible, the display angle of the card display panel may be adjusted to suit the requirements of each individual player.

In one important aspect of the invention, the support bag has a wide bottom panel, a relatively narrow top panel and sloping side panels which enclose the aggregate material. An instruction sheet display panel is secured to one of the sloping side panels for receiving and displaying a sheet of printed instructions. According to this arrangement, the flexible sides of the support bag can be moved in and out as necessary to adjust the display angle of the instruction sheet display panel for convenient viewing by the player.

The novel features which characterize the invention are defined by the appended claims. The foregoing and other objects, advantages and features of the invention will hereinafter appear, and for purposes of illustration of the invention, but not of limitation, an exemplary embodiment of the invention is shown in the appended drawing.

DESCRIPTION OF THE PREFERRED EMBODIMENT

Figure 1:
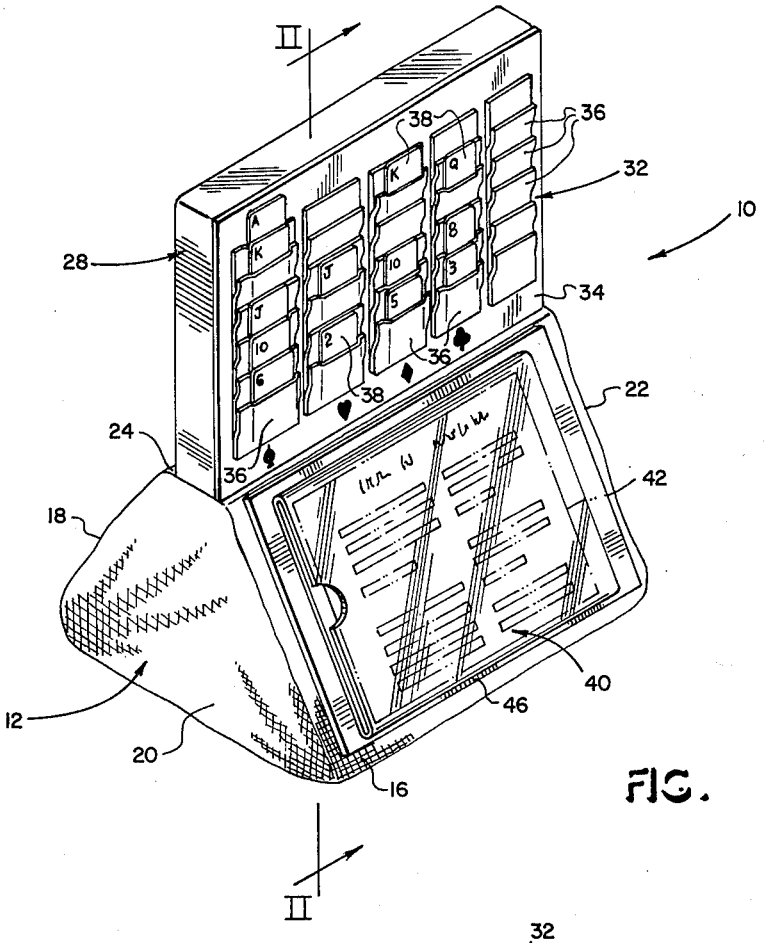
FIG. 1 is a perspective view of a card holder assembly constructed according to the teachings of the invention.

In the description which follows, like parts are marked throughout the specification and drawing with the same reference numerals, respectively. The drawings are not necessarily to scale and in some instances portions have been exaggerated in order to more clearly depict certain features of the invention.

Referring now to FIG. 1, the invention is embodied in a card holder assembly 10 which features a flexible support bag 12. The support bag 12 is provided with a wide bottom panel 14, front and rear sloping side panels 16, 18 respectively, left and right side panels 20, 22 and a relatively narrow top panel 24. The bottom, top and side panels are interconnected along common edges to enclose a volume of flowable, aggregate material 26.

Secured in up-right relation to the top panel 24 is a card display panel 28. The card display panel 28 is secured on its lower end to an anchor plate 30. The top panel 24 is secured, preferably by an adhesive bond, to the anchor plate 30.

Figure 2:
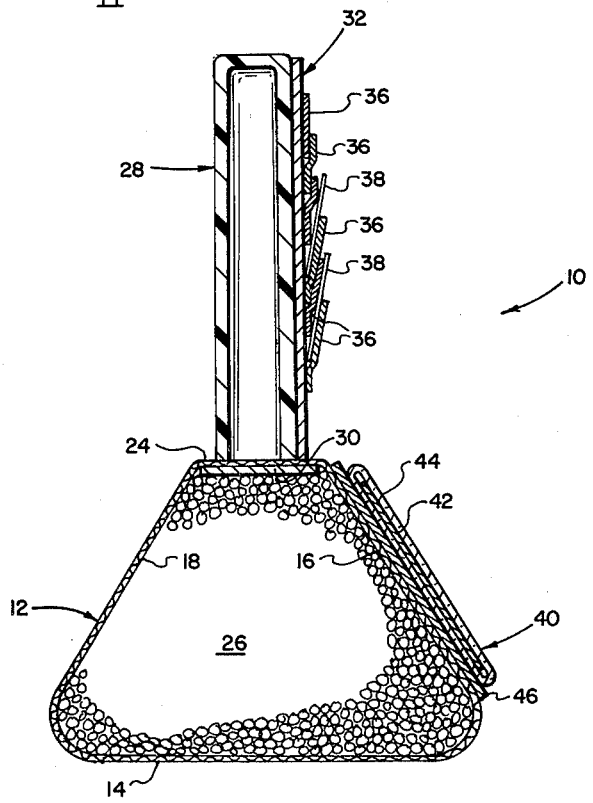
FIG. 2 is a sectional view of the card holder assembly taken along the lines II—II of FIG. 1.

The purpose of the display panel is to hold a number of cards which comprises a hand for a particular game. Therefore, the display panel is preferably constructed of light-weight plastic material. As can best be seen in FIG. 2, the card display panel is made of a thin gauge plastic material and is hollow so that the overall assembly will have a low center of mass which coincides substantially with the mass of aggregate material 26.

The purpose of the aggregate material 26 is to stabilize the assembly in an up-right display position, so that the display face is oriented for convenient viewing. The sides of the support bag 12 are flexible and the aggregate material inside is flowable so that the display angle of the card display panel 28 can be easily adjusted by pushing the display panel either toward or away from the viewer, as desired.

For best adjustability, the support bag 12 is preferably constructed of a durable fabric material such as cotton denim, and the aggregate material preferably comprises a flowable mass of relatively heavy particulate material such as pebbles or sand. However, other aggregate material such as marbles or beans may be used to good advantage.

The principal object of the invention is to provide a holder for receiving a hand of playing cards which can be used effectively by a handicapped player who is unable to hold and manage the cards. Accordingly, an array of individual card pockets 32 is secured to the front face 34 of the up-right card display panel 28. The card pockets 32 may be arranged in any convenient fashion within the array. However, they preferably are arranged in a number of rows and columns whereby the playing cards dealt in a particular hand can be arranged and displayed by suits, and by rank within a suit as shown in FIG. 1. The card pockets 32 are preferably formed by overlapping plastic material so that each playing card, for example playing card 38, is securely gripped in frictional engagement by the side-walls of the pocket 36, whether the card holder is inadvertently tipped over or is deliberately tilted over, face down for privacy, wherein the cards will remain securely in place. Moreover, according to this arrangement, individual cards may be selected and withdrawn from the pocket 36 without disturbing the remaining cards.

Referring again to FIG. 1, it will be seen that the cards of a typical bridge hand have been arranged on the card holder assembly 10 by suits, and by rank within each suit. An additional column of pockets is provided on the far right to accomodate a hand which has been dealt with an unusually long run of one suit.

Secured to the front panel 16 is a display panel 40 for receiving and displaying a sheet of printed instructions 42. The display panel 40 is provided with a transparent overlay 44 which forms a pocket in which the printed sheet 42 is received. The transparent overlay is secured to the bottom plate 46 which is firmly bonded to the front panel 16. According to this arrangement, printed instructions such as bidding rules or scoring rules can be displayed simultaneously with the hand of playing cards.

It will be appreciated that a handicapped player who is otherwise unable to hold and manage a hand of playing cards can use the card holder assembly 10 to fully participate in a card game without assistance. Moreover, the handicapped player is able to arrange his cards by suit and by rank within a suit as desired, and to select a particular card and remove it without disturbing the remaining cards. Should the card holder assembly 10 be upset for any reason or be tipped over on its face for privacy when the player has temporarily left the playing area, for example during a break in the playing time, the cards will be securely held in place. While the playing cards are clearly displayed to the player, the arrangement of the cards affords privacy with respect to other players.

Although a preferred embodiment of the invention has been described in detail, it should be understood that various changes, substitutions and alterations can be made therein without departing from the spirit and scope of the invention as defined by the appended claims.

What is claimed is:

1. A holder for displaying a hand of cards comprising, in combination:

a flexible support bag having a wide bottom panel, a relatively narrow top panel, and sloping side panels interconnecting the top and bottom panels;

a volume of flowable, aggregate material disposed within said support bag;

an upright card display panel secured to the top panel of the support bag, said card display panel including an array of card pockets arranged in row and columns; and, an instruction sheet display panel secured to one of the sloping side panels for receiving and displaying a sheet of printed instructions.

* * * * *